United States Patent [19]

Uetrecht

[11] 4,056,995

[45] Nov. 8, 1977

[54] SINGLE MASTER TONE GENERATOR

[75] Inventor: Dale M. Uetrecht, Cincinnati, Ohio

[73] Assignee: D. H. Baldwin Company, Cincinnati, Ohio

[21] Appl. No.: 563,431

[22] Filed: Mar. 31, 1975

Related U.S. Application Data

[62] Division of Ser. No. 449,990, March 11, 1974, which is a division of Ser. No. 147,976, May 28, 1971, Pat. No. 3,816,635.

[51] Int. Cl.[2] ..... G10H 1/00

[52] U.S. Cl. ..... 84/1.01; 84/1.11; 84/1.19

[58] Field of Search ..... 331/51, 53; 84/1.01, 84/1.17, 1.19, 1.11; 307/225, 226; 328/38, 39, 41, 42

[56] References Cited

U.S. PATENT DOCUMENTS

| | | | |
|---|---|---|---|
| 3,590,131 | 6/1971 | Reyers | 84/1.03 |
| 3,601,518 | 8/1971 | Hill | 84/1.19 X |

*Primary Examiner*—Ulysses Weldon
*Attorney, Agent, or Firm*—Kirkland & Ellis

[57] ABSTRACT

An electronic organ in which all the tones of the musical gamut are obtained by operations on the output of a single tone signal source, utilizing digital techniques to divide the frequency of the tone signal by appropriate integers.

2 Claims, 15 Drawing Figures

CLOCK
9.1MHZ
10
12
13
11
1/2
1/4
1/8
1/16
1/32
1/64
1/128
1/256
1/512
1/1024
512
256
128
64
32
16
8
4
2
1
20
30
31
40
21
22
ADDER
967
913
861
813
767
714
684
645
609
575
543
DIVIDERS
41
29
c
B
A#
A
G#
G
F#
F
E
D#
D
C#
DIVIDE BY TWO CHAINS
KEY SWITCHES
STOP TABS & FILTERS

| | 0 | 1 | 2 | 3 | 4 | 5 | 6 | 7 | 8 |
|---|---|---|---|---|---|---|---|---|---|
| | R | S | R | S | R | S | R | S | R |
| DESIRED TIMING | 0 | 43 5/8 | 87 1/4 | 130 7/8 | 174 1/2 | 218 1/8 | 261 3/4 | 305 3/8 | 349 |
| ACTUAL TIMING | 0 | 43 1/2 | 87 | 131 | 174 1/2 | 218 | 261 1/2 | 305 1/2 | 349 |

CLOCK
200
Δf1
202
Δf2
203
Δf3
204
≈-1 CENT
≈-3 CENTS
≈ 2 CENTS
1/2
205
1/4
207
1/8
209
1/16
211
1/16
212
1/16
213
1/16
214
c# thru c
201
206
208
210
215
216
217
218
+1.5 CENTS
-.5 CENTS
-1.5 CENTS
+.5 CENTS
+1.5 CENTS
-.5 CENTS
-1.5 CENTS
+.5 CENTS

SINGLE MASTER TONE GENERATOR

The present application is a division of U.S. application Ser. No. 449,990, filed Mar. 11, 1974, assigned to the assignee of the present application. Ser. No. 449,990 is a division of Ser. No. 147,976, filed May 28, 1971 now U.S. Pat. No. 3,816,635, issued June11, 1974, and assigned to the assignee of this application.

BACKGROUND OF THE INVENTION

A conventional form of electronic organ tone generator utilizes twelve independently tunable master oscillators, one for each tone nomenclature of the musical scale, and employs a separate frequency divider chain synchronized from each of the master oscillators, to obtain ranges of related notes. This system has no automatic mechanism for maintaining the master oscillators relatively tuned, so that stable master oscillators must be employed, and retuning is required from time to time. In addition, the tone signals of any one nomenclature are phase and frequency locked, which is not true of pipe organ tones, whereby the latter cannot be accurately simulated in pitch.

Another type of commercial organ utilizes independent oscillators throughout for the tones of the organ. The tuning problem is thus exacerbated but phase and frequency locking are avoided.

The advent of rate scaling, which is fully explained in an article published in *Electronic Design* 3, Feb. 1, 1968, by Richard Phillips, provides an economical technique which can be employed to divide any number by any other number, and to multiply any number by any other number, including fractional numbers, as A/B, and to add or subtract any number to or from any other number. The rate scaling technique and other digital methods are applied in the present invention to derive tone frequencies closely approximating true scale frequencies, as required by an electronic organ, from a single master oscillator by wholly electronic techniques.

A number of diverse implementations of the basic techniques have been devised, each of which has its advantages and its disadvantages. It is desirable to employ a master frequency of under 2 mhz, and in fact as low as possible, in order that MOSFET technlogy may be employed. Frequencies having the precise ratios 3/2 or 4/3 must be avoided, or undesired beats may be heard. Frequency deviations from true tempered scale frequencies must be minimized or at least maintained within musically acceptable limits. This combination of requirements is difficult to meet, though any one singly may be easily met.

Since only one master oscillator is required to achieve and maintain correct relative tuning between notes, it becomes pratical, in the present system, by means of a single control, to tune the master oscillator to obtain key transpositions.

It is feasible to obtain the full tone range of an organ by deriving each note separately by rate scaling, or to obtain only master oscillation frequencies in this way. The first mentioned possibility has the advantage of providing unlocked tones, but there are other practical advantages in so proceeding in terms of grouping or locating tone sources so as to simplify or eliminate wiring.

One method of implementing the single master oscillator set of an organ system otherwise conventional, is to utilize twelve conventional dividers each related to the next by essentially the twelfth root of two. This is referred to as the integer system. Its inventive component resides in the selection of appropriate multipliers, all of the form 1/A.

A more subtle system is to rate scale the output of the master oscillator to obtain twelve frequencies at ratios related each to the next by the twelfth root of two to provide octave of tone signals. These frequencies can then be scaled down by identical conventional dividers. This system is referred to as the rate scaled system. The selection of suitable rate scaling divisors is important.

In a third system, sub-groups of fewer than twelve dividers are each related to the next by the twelfth root of two, and the master oscillator frequencies so derived are further divided to obtain new master oscillators for each of the sub-groups. This is referred to as the complex system.

Useful series of integer numbers available for implementing the present invention are selected from among the series 116–219, 239–451, 349–659, 543–1024 and 254–359, all inclusive. These sequences include close approximations to numbers related as the twelfth root of two. For example, high C in an organ is properly 8372.hz. The first series of numbers suggests 116 × 8372. = 970,000.hz as a master oscillator. The number 970,000 can then be divided by 116 to obtain approximately 8372.

Other numbers in the series are then employed for other notes in the same way. If an octave of tone signals is to be derived in this way the relation 3/2 or 4/3 is found to occur and errors of as much as ± 2.7 cents. This is musically undesirable but usable.

The 239 series requires a master oscillator at 2,000,000 hz and contains two possible sequencies of twelve integers, properly related.

SUMMARY OF THE INVENTION

Systems of deriving organ tone signals from a single master oscillator, and involving sophisticated techniques for employing a low frequency master oscillator, deriving tone frequencies having requisite relative accuracies but no undesirable relations among themselves, by means of dividers employing redundant elements, for economy of implementation.

DESCRIPTION OF DRAWINGS

FIG. 4A and 4B, and 5A and 5B are block diagrams of single master oscillator systems for generating an octave of tone signals for rate scaling with two series of appropriate multipliers of the form 1/A; where A is an integer.

FIG. 5C is a system of the same character as the systems of FIGS. 4A, 4B, 5A and 5B, but with multiplication factors 2/A and 4/A;

FIG. 1

Figure 1:
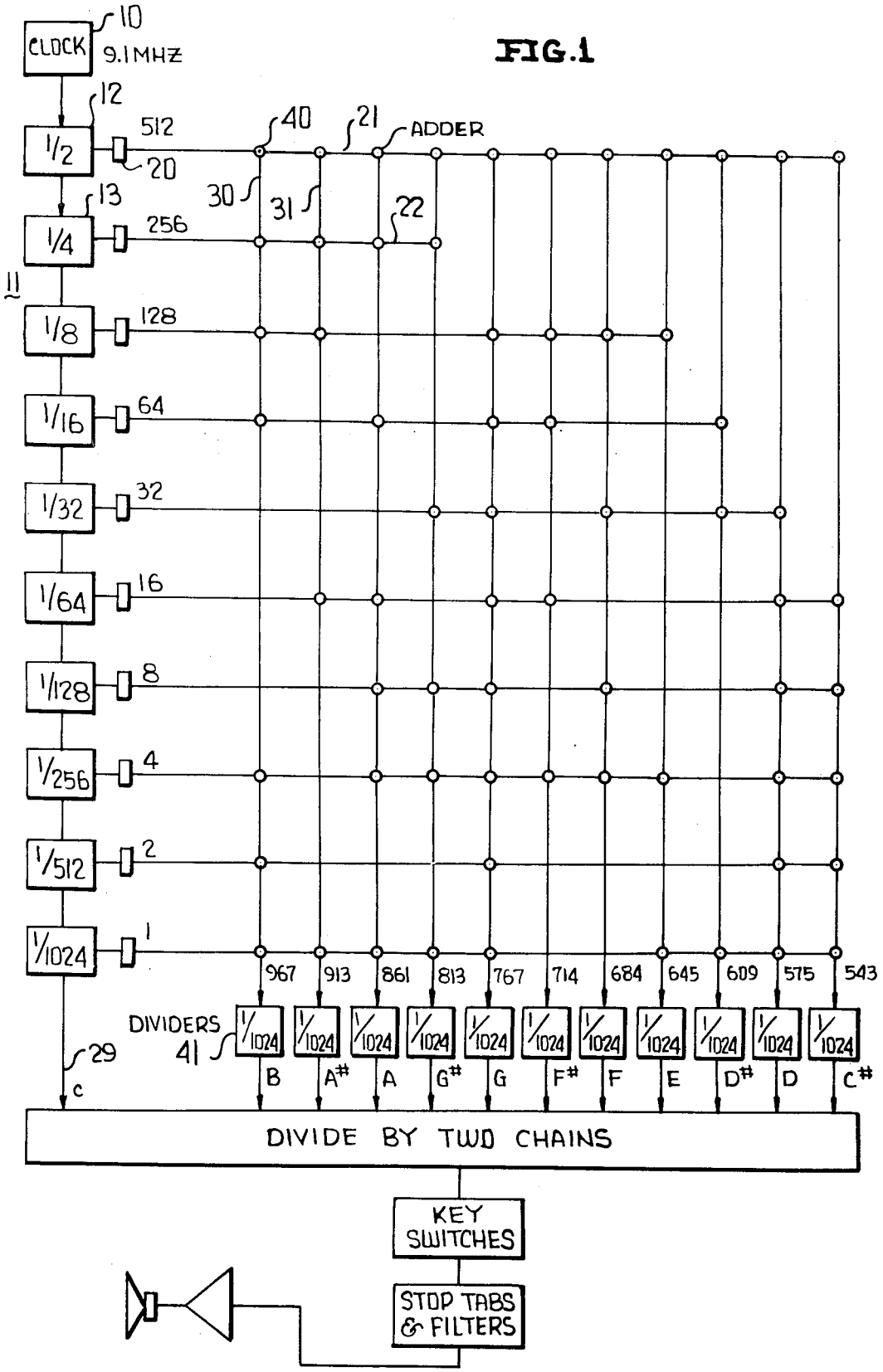
FIG. 1 is a block diagram of a single master oscillator system by dividing the latter by two, and each product of division by two, in a plurality of steps, and then rate scaling and adding, to obtain the ultimately desired frequencies.
Figure 2:
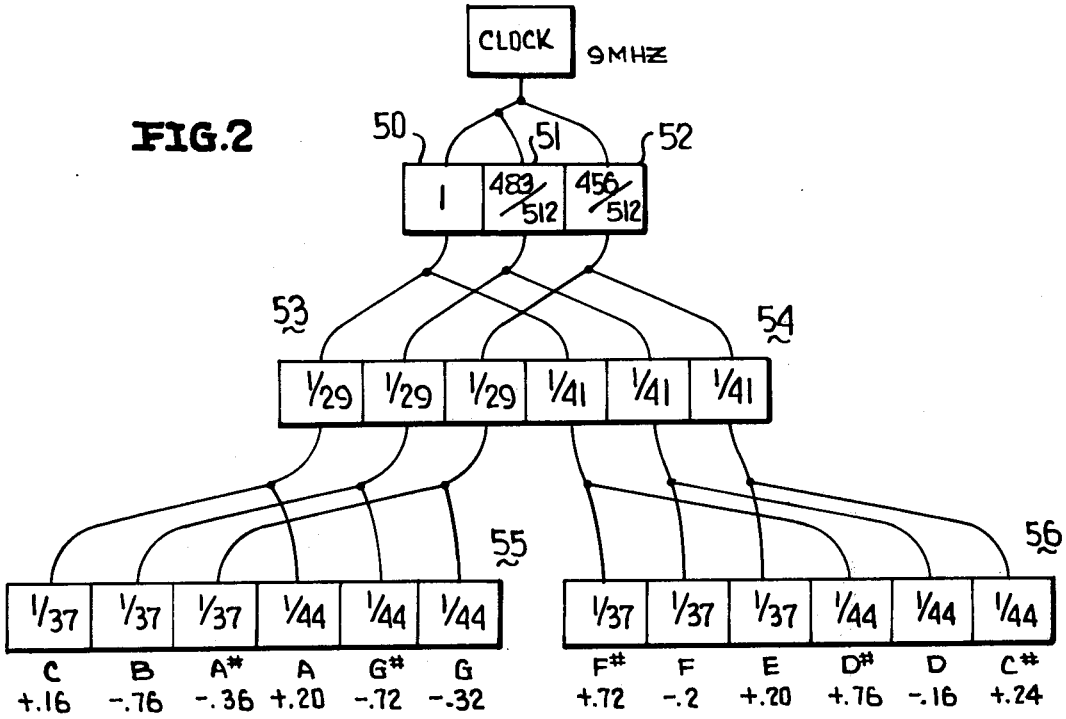
FIG. 2 is a block diagram of a simplified system for deriving an octave of tone frequencies of an organ by combining rate scaling and integer division.

A master oscillator 10 of 9.1 mhz is employed. Successive divisions by two are then achieved in conventional binary divider chain 11, in ten steps. The numerals in the blocks 12, 13, etc. recite the division factor, totalized. The numerals to the right of the block represent the number of pulses out, obtained by right scaling, in rate scalers 20, for each 1024 pulses of the master oscillator 10. The pulses from the separate rate scalers 20 are applied to separate horizontal buses 21, 22 etc. Junctions of buses 21, 22 with vertical buses 30, 31 etc., indicated by circles 40, indicate pulse rate summers or adders. So, in bus 30, we have the sum of 512, 256, 128, 64, 4 and 2 or 967 B pulses out of each 1024 present in the clock output. This represents a shift of one semitone, from C, obtainable by ten divisions by two. Division by 1024 can be achieved by a conventional binary divider as at 41. The outputs of the dividers 41, for the twelve vertical lines 30, 31 . . . , then provide frequencies appropriate to the notes of the musical scale starting at B and ending at C#.

The system of FIG. 1 can then be used to derive a set of master oscillators for an electronic organ, if desired, or any other tones of an organ. The only disadvantage of this system is that noise jitter results from the rate scaling. The divisions by 1024 minimize this noise to an acceptable level but require a 9.1 mhz clock.

FIG. 2

The clock frequency is 9.mhz. This output is multiplied in three parallel dividers 50, 51, 52, by the factors 1, 483/512, 456/512 by rate scaling. Each output of these dividers is further divided in two parallel channels, by means of dividers 53, 54 respectively having division ratios of 29 and 41 respectively for each of dividers 50, 51, 52. The latter dividers can be conventional. The outputs of dividers 53 are further divided each by 37 and 44, in dividers 55 and the outputs of dividers 54 by the same factors in dividers 56. Each of the ultimate dividers is labelled with the musical nomenclature of its output, and with the cents error of the tone frequency. For example, the note C is obtained from 9 mhz, by successive divisions by 29 and 37, but the note B by successive multiplication by 483/512, 1/29, 1/37. An octave of tones is thus generated, utilizing a relatively small number of diverse rate scalers, which simplifies manufacture.

FIG. 3

Figure 3:
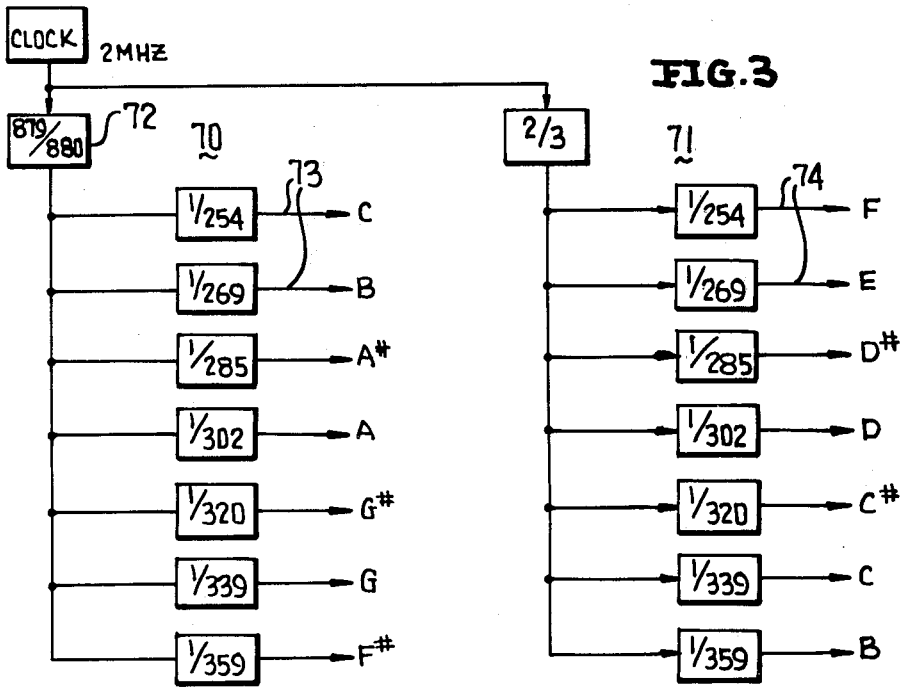
FIG. 3 is a block diagram of a system for obtaining a sequence of fourteen consecutive musical tones, from a 2 mhz oscillator, in two channels.

In FIG. 3, the clock frequency at 2 mhz is divided into two parallel channels, 70 and 71.

Channel 70 contains a rate scale divider 72, having the ratio 879/880, from which diverge seven dividers, 73, which provides division by 254, 269, 285, 302, 320, 339, 359, respectively. The channel 71 contains a master divider which multiplies by $\frac{2}{3}$, and is followed by seven dividers in parallel, 71, providing the same ratios as in channel 70. The two sets of frequencies are shifted from each other by seven semitones, so that together they constitute a continuous sequence of semitones.

Figure 3A:
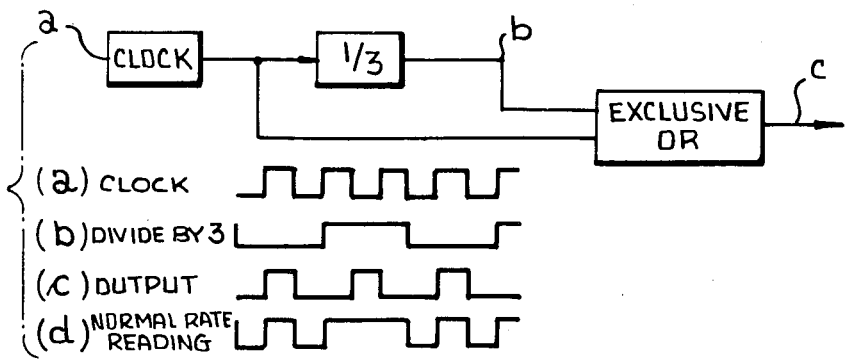
FIG. 3A is a block diagram of a rate scaler, together with wave forms appropriate thereto.

Multiplication by 1/A can be achieved by conventional division, multiplication by 879/880 and $\frac{2}{3}$ can be achieved by simplified rate scaling technique. This technique utilizes the fact that the numerator of each ratio is one less than the denominator. The general technique is to divide a series of clock pulses by an integer (example 3). The result is combined in an EXCLUSIVE OR gate with the original clock pulses. The result is that there is one less pulse at the output than at the input during one period of the divided signal, leaving two output pulses for each three input pulses. An additional advantage is also obtained. The boolean algebra relation of an EXCLUSIVE OR is $C = AB + AB$. FIG. 3A, shows that given a uniform series of clock pulses, the divide-by-three and EXCLUSIVE OR results in a uniform series of pulses at $\frac{2}{3}$ the clock rate. However, the pulse train which is obtained by normal rate scaling techniques is not a uniform series of pulses and contains noise jitter. The ratio 879/880 is not critical but gives a correction of 2 cents which is required to compensate for the fact that $\frac{2}{3}$ is a shift of 7 semitones plus 2 cents. As an alternative the output D, which is obtained by division of $\frac{2}{3} \times 1/302$ could be divided by 2 and used to obtain a correction of 905/906 when combined with the clock in an EXCLUSIVE OR circuit. This correction is slightly less than 2 cents.

FIGS. 4A & 4B

Figure 4A:
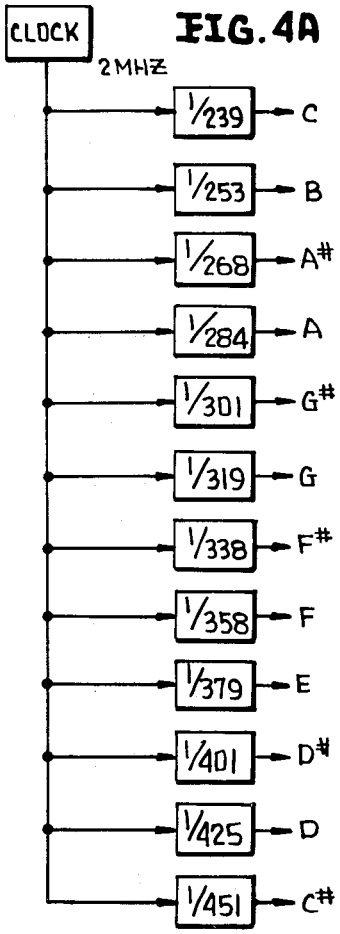
Figure 4B:
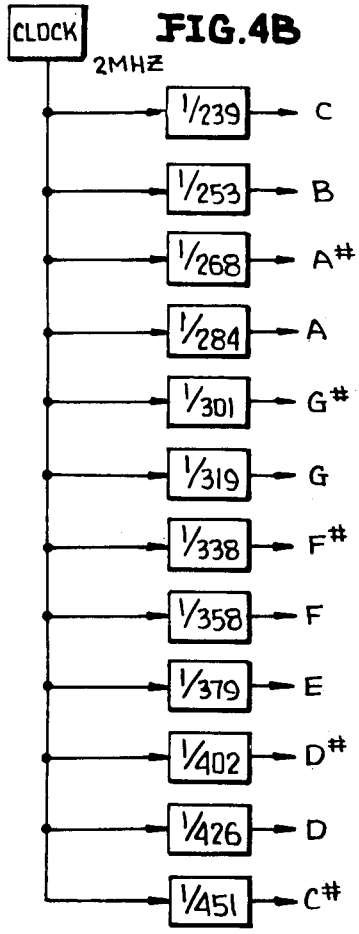

These figures illustrate simple systems in which, starting from a 2 mhz clock signal, a chain of dividers, all connected in parallel to the clock, provide close approximation to the correct musical frequencies. In FIG. 4B, A#3/2D# and A=3/2D, and the overall system has ± 1.3 cents error. In FIG. 4A, the divisor for D# is 401, instead of the 402 used in FIG. 4B. Similarly, D has a divisor of 425 for FIG. 4A, but 426 in FIG. 4B. FIG. 4A provides an error of ± 2 cents, but the absence of the small ratio 3/2, among tone frequencies, is made musically preferable. The essential features of the system of FIGS. 4A and 4B resides in the selection of dividers all in the form 1/A, and the ability to use a 2 mhz master oscillator.

FIGS. 5A, 5B, 5C

These figures follow the general arrangement of FIGS. 4A and 4B, but with different clock frequencies and consequently, different division ratios to match, so that as one moves down the musical scale, the computed frequencies decrease as the $12\sqrt{2}$, to a close approximation. In FIG. 5A, all dividers are of the form 1/A but in FIG. 5B some factors are of the form 2/A. FIG. 5C also requires factors of the form 4/A, but permits implementation with a master frequency of about 750.khz.

FIG. 5D

Figure 5D:
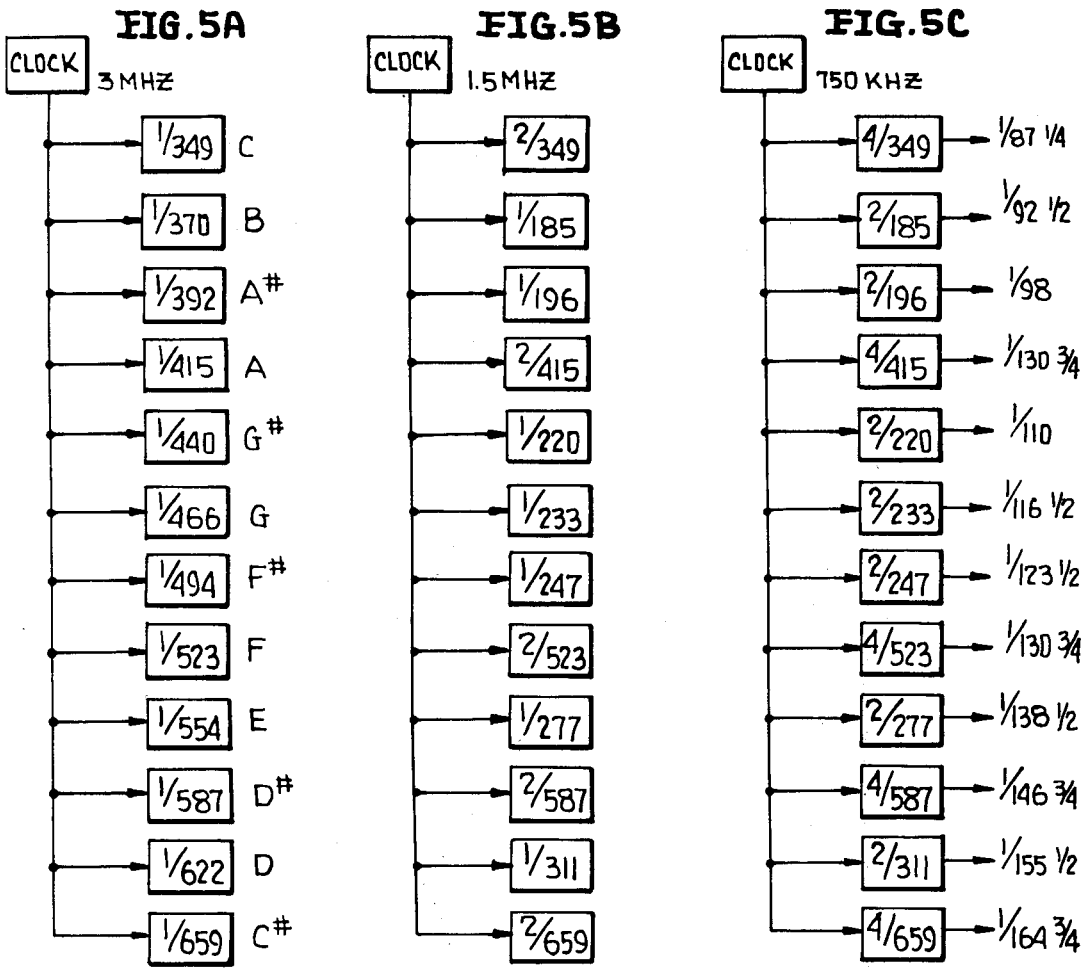
FIG. 5D illustrates in block diagram a system for obtaining division of the factors 2/A and 4/A, required in the systems of FIG. 5C.
Figure 5D:
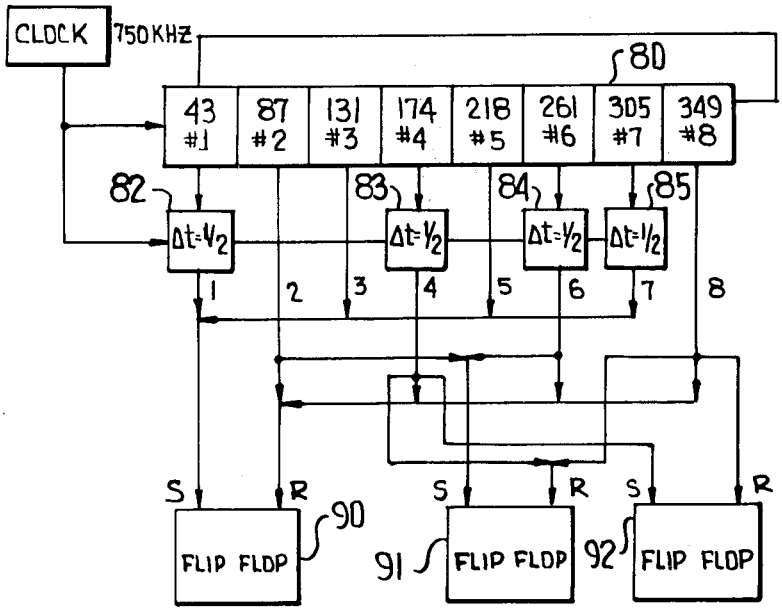

FIG. 5D shows the method for obtaining the factors 4/A and 2/A, as required in the system of FIG. 5C. 80 is a divide-by-349 register having eight sections, each of which provides one pulse out after the number of clock input pulses have been achieved as designated in the figure.

The outputs of stages #1, #4, #6, #7 are delayed by ½ clock pulse in delay devices 82–85 inclusive, while the outputs of stages #2, #3, #5, #8 are not delayed.

Three set-reset flip-flops 90, 91, 92 are provided, which are controlled by the register.

The divider system of FIG. 5D is an exemplary divider system, employed for deriving the factor 4/349. Similar circuits are available for the factors required by other of the notes of FIG. 5C, and therefore of FIG. 5B.

Essentially the register 80 counts to 349, but output pulses are derived at times 43, 87, 131, 174, 218, 261, 305, 349. Assuming that flip-flop 90 is reset at time 0, just as the first of 349 pulses is being inserted into the register 80, the flip-flop is set at time 43–½, allowing for the delay introduced by 82, and is reset from the output of stage #2, at time 87. It is then set from stage #3 at time 131, reset at time 174–½, allowing for the delay of device 83, set at time 218, reset at time 261–½, set at time 305–½ and reset at time 349. This implies that the times of completion of cycles of the flip-flop occur at times 87, 174–½, 261–½and 349. The timing of the first cycle which should have been at 87–¼, is ¼ of a clock reference cycle fast. The time of the second cycle is precise, the time of the third cycle is ¼ clock reference cycle fast and the time of the last cycle is precise. The timing over 4 cycles is thus made up of slightly unequal cycles, but the timing for four cycles is correct, so that the average timing is correct. The slight subharmonic produced is not musically audible. This is shown in Table 5E.

Pulses 2 and 6 can be used to set flip-flop 91, and pulses 4 and 8 to reset flip-flop 91. Pulse 4 can be used to set flip-flop 92 and pulse 8 can be used to reset flip-flop 92. These flip-flops thus operate at ½ and at ¼, respectively, of the frequency of flip-flop 90, and the system procudes 3 octavely related tones. The outputs of 91 and 92 do not have any subharmonic content.

The register itself, and its component stages, can be most economically implemented employing the techniques of an article published by R. Clive Chest, in *The Electronic Engineer,* April, 1968, pages 49, 50, 52. However, the system is not restricted to this implementation. The ability to multiply by fractions of the form 2/A, 4/A implies that a low clock frequency can be used, which is required in the present state of the MOSFET integrated circuit art.

Again referring to FIG. 5D, if the clock frequency is changed to 1.5 mhz, outputs #1, #3, #5, and #7 are deleted and flip-flop 90 is deleted, we obtain the C output of FIG. 5B from flip-flop 91 and ½ of this frequency from flip-flop 92.

Figures 5E, 6:
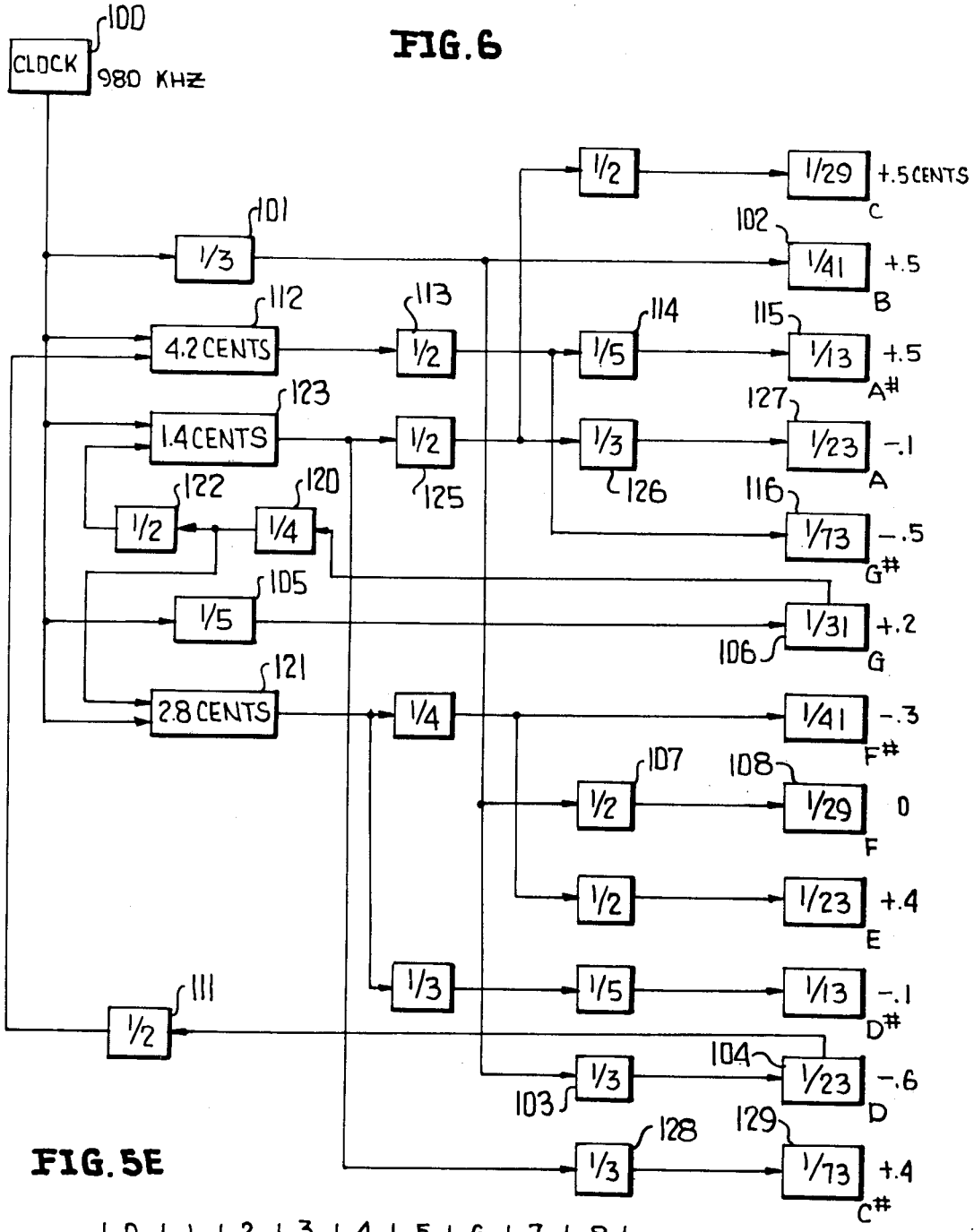
FIG. 5E is a listing of the counting sequence present in the system of FIG. 5D, and assists in explaining the operation of the later system.
FIG. 6 is a block diagram of a system for deriving a useful series of tone frequencies by correcting certain undesirable frequencies obtainable by simple division.

The division ratios of FIG. 6 derive from the number series 116, 123, 130, 138, 146, 155, 164, 174, 184, 195, 297, 219. This series provides a fair fit for the clock frequency 980 khz but there exists one error of 2.7 cents, and all but one frequency are related to another by the factor 3/2 or 4/3, so that the series is not usable. The system in FIG. 6 concerns itself with the correction of individual output frequencies of an almost useful series, so as to produce a useful series.

Correction is obtained by dividing certain of the outputs by simple factors, and combining the divided number with the clock frequency, in an "EXCLUSIVE OR " circuit, which eliminates one pulse, per period of the divided frequency. For example the D frequency is obtained from the clock frequency by multiplying by $\frac{1}{3} \times \frac{1}{3} \times 1/23 = 1/207$. If we divide the D frequency by 2, and combine the result in and "EXCLUSIVE OR" circuit with the clock frequency, one pulse will be lost from the clock frequency per period of the D frequency, i.e., for each 414 cycles of the clock frequency the "EXCLUSIVE OR" output will provide 413 pulses for a ratio of 413/414 or a correction of −4.2 cents. If now, the output of the EXCLUSIVE OR gate is divided by $10 \times 13 = 130$, there will result and A# tone, which will have an error of only +0.5 cents.

The technique of FIG. 6 can be employed by effect correction of tone frequencies where a set of divisors is suitable for operating only on one unduly high clock frequency, by providing a simple way of correcting the clock frequency by a small amount. The system of FIG. 6 is suitable for a 980 khz clock frequency, which is well within the capabilities of MOSFET integrated circuitry.

In FIG. 6, 100 is a clock, which provides square wave forms 980 khz. This oscillator is tunable sufficiently to enable key transportion of tones, if desired.

To derive a B, the output of clock 100 is divided by 3, in divider 101, and by 41, in divider 102. To derive D, factors of ⅓, ⅓ and 1/23 are employed, in dividers 101, 103, 104. G is provided by dividing by 5 and 31, in dividers 105, 106. F is derived by division by 3, 2, 29, in dividers 101, 107, 108. All other notes, i.e., C, A#, A, C#, F#, E, D#, C#, required correction of the clock to obtain the accuracy in cents indicated.

To effect the correction, the D output is divided by 2, in divider 111 and applied to EXCLUSIVE OR gate 112 together with the clock pulses. This results in a correction of 4.2 cents in the clock pluse which is passed on to divide by 2 circuit, 113, divide by 5 circuit 114, and divide by 13 circuit 115, to provide a corrected A#. The output of divider 113 is also applied to divide by 73 circuit 116 to provide a G#.

The output of divider 106 is applied via a divide by 4 circuit 120 to EXCLUSIVE OR gate 121, and via divide by 4 circuit 120 and divide by 2 circuit 122, in cascade to EXCLUSIVE OR gate 123. The latter becomes a new clock which generates A, by division by 2, 3, 23, and dividers 125, 126, 127, and generates C#, by divide by 3 and 73, in dividers 128, 129.

F# is generated from EXCLUSIVE OR gate 121 used as a corrected clock, by division by 4 and 41, D# from corrected clock 121, by division by 3, 5, 13, E from corrected clock 121 by division by 4, 2, 23, and C from corrected clock 123, by division by 2, 2, 29.

The final series of tones has no internal undesired frequency ratios, and the maximum deviation from correct frequency is −0.6 cents.

The system of FIG. 6 involves elimination of pulses from the clock frequency periodically. This is noise, with no recognizable pattern but of a small enough amplitude that it is not musically objectionable, which was determined by bread boarding a single note and rate scaling. This experimental evidence indicates that the clock could be lowered to 245 khz to obtain a 1000 hz to 2000 hz top octave without objectionable noise.

Explaining the rationable of the system further, D is obtained by dividing the clock output by 207. Divider 111 increases the division ratio to 414. If one pulse is substracted from the clock for each 414 of its cycles, it has been corrected by 4.2 cents.

Figure 8:
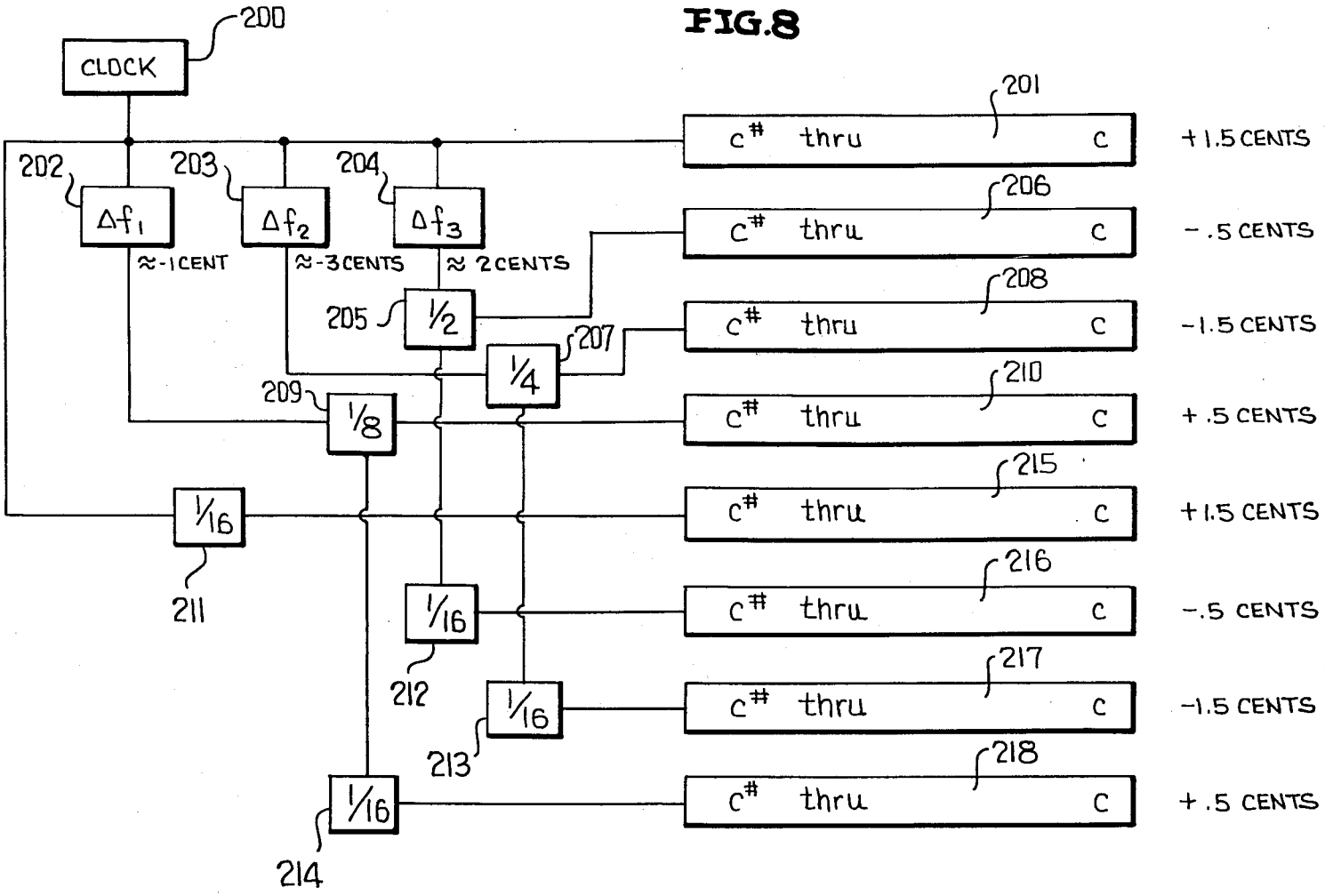
FIG. 8 is a block diagram of a system for deriving multiple octaves of tones which are slightly detuned with respect to each other, by amounts selected to achieve musical effects.

In FIG. 8, 200 is a clock pulse generator, which drives five circuits in parallel. Of these five circuits, 201 is a tone signal source covering the uppermost octave of an organ, extending from C# to C, but which is 1.6 cents high in frequency, by proper selection of the clock frequency. FIGS. 1-5, inclusive, disclose suitable devices and arrangements for the purpose. The clock also derives pulse frequency shift devices 202, 203, 204 which are rate divided, for introducing small frequency shifts <f, <f2 and <f3, of extent −1 cent, −3 cents and −2 cents for example. The devices 202, 203, 204 at their outputs provide the equivalents of three additional master pulse oscillators or sources, slaved to the clock source 200.

The output of frequency shift device 204 is divided by 2 in divider 205, which in turn controls an octave of tone signal sources 206, displaced by one octave from the frequencies of the signal source 201, by 2 cents.

The output of pulse frequency shifter 203 is divided by four, in divider 207, which in turn drives tone signal source 208. The output of pulse frequency shifter 202 is divided by eight, in divider 209 which in turn drives tone signal source 210. Source 206, 208, 210 each cover one octave of tones, but these are displaced from tones of corresponding nomenclature of source 201, by 2 cents, −3 cents and −1 cent.

The clock 200 and the dividers 205, 207, 209 are each divided by sixteen, by dividers 211, 212, 213, and 214, respectively. These retain the shift zero cents absolute, and −2 cents, −3 cents and −1 cent, relative, and drive four additional tone sources 215, 216, 216, 218, respectively.

The array of eight octaves thus represents unlocked frequencies within the first four and the last four octaves. The principles of the invention clearly lend themselves to generating any number of octaves all of which are relatively unlocked, but all of which are ultimately controlled by the same clock 200. The latter can be crystal controlled, if desired, or tunable. Each alternative has advantages, in a musical instrument.

Figure 9:
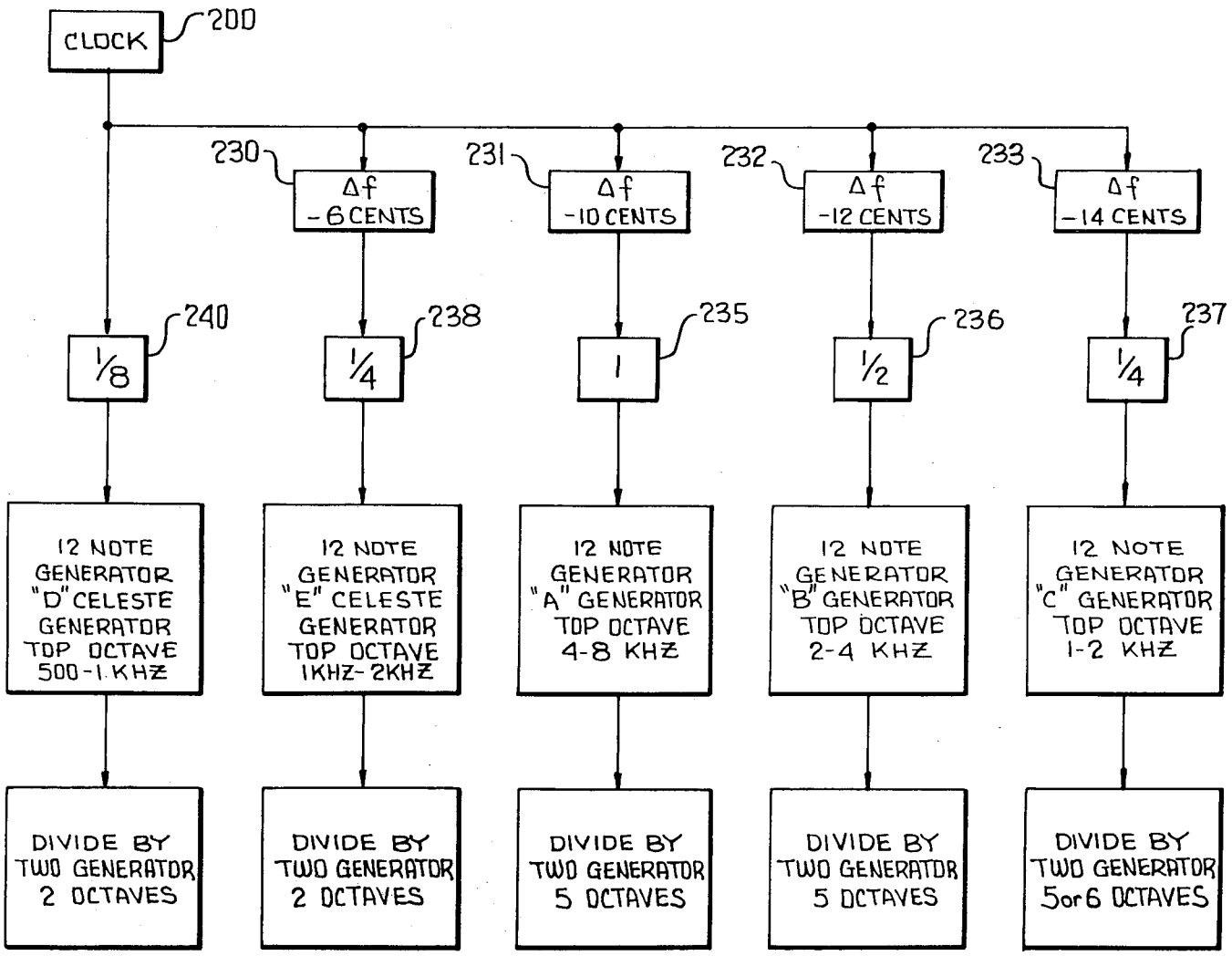
FIG. 9 is a block diagram of a system for providing tone generators suitably detuned to produce celeste and chorus effects.

The principles of the invention can be employed to provide multiple tone generators, as in FIG. 9. These can be relatively detuned, so that certain of the generators can provide ensemble effect, while others can provide a celeste effect. For example, clock 200 can dirve four digital frequency shifters 230-233, which provide shifts of −6 cents, −10 cents, −12 cents and −14 cents, respectively. These together with the direct output of the clock provide five clocks, in effect.

Shifters 231, 232, 233 may have their frequencies modified by the division factor 1, 1/2 and 1/4, in units 235, 236, 237, respectively, which in turn act as clocks for three A2-note master generators of the types disclosed in FIGS. 1-7, the "A", "B" generators of an organ, covering the frequency bands 4-8 khz, 2-4 and 1-2 kh respectively. These master generators, which cover the top octaves of each generator, may then each drive five octaves of divide by two divider clocks, to generate the gamut of tones required by a complete organ. The latter step is conventional.

The direct output of the clock is divided by eight, in divider 24, and the output of shifter 230 by four, in divider 238, and provide clocks for celeste generator top octave generators D and E covering, respectively, the bands 500-1000 hz and 1-2 khz.

It is important that each of the 12-note generators and each of the divide by two generators are wholly digital, and duplicative, since this reduces the cost of producing the MOS chips required to implement the system. It would be feasible to produce the entire tone system of FIG. 9, except for the clock, on a single chip, were it not for the problem of providing output loads. It is also possible to construct the tone generators A, B, C, D, E according to the principles set out in FIG. 8, to obtain wholly unlocked tones, instead of proceeding with a divide by two implementation.

Figure 7:
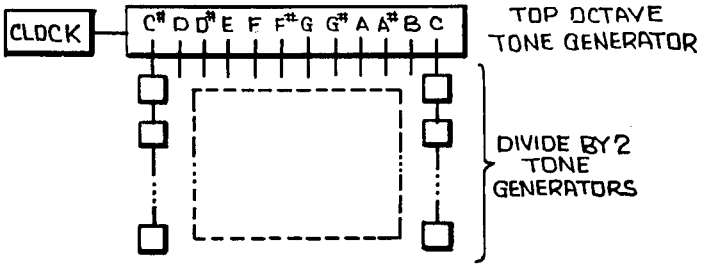
FIG. 7 is a block diagram of an organ system, employing a single master oscillator.

FIG. 7 illustrates an organ system which is conventional except that the highest octave of organ tone signals is derived from a single master oscillator or clock. This figure is essentially the same as FIG. 1, but is less burdened with details, and can employ any of the systems of FIGS. 2, 3, 4A, 4B, 5A, 5B, 5C, 6.

What I claim is:

1. In an electronic musical instrument, the combination comprising a pair of frequency synthesizer, a source of clock pulses connected to one of said frequency synthesizers, and frequency divider means connected with said source for dividing the pulse repetition rate of said clock pulses by a factor which differs slightly from 2, said frequency divider means being connected to another one of said frequency synthesizers.

2. Apparatus according to claim 1, wherein said frequency divider means includes deriving means for deriving a train of pulses having a pulse repetition rate which differs from said clock pulses by a factor of two, and means connected with said deriving means for periodically omitting pulses from said train.

* * * * *

UNITED STATES PATENT AND TRADEMARK OFFICE

CERTIFICATE OF CORRECTION

PATENT NO. : 4,056,995

DATED : November 8, 1977

INVENTOR(S) : DALE M. UETRECHT

It is certified that error appears in the above-identified patent and that said Letters Patent are hereby corrected as shown below:

Column 1, line 37, insert -- tempered -- after "true";

Column 2, line 34, "sequencies" should be -- sequences --;

Column 2, line 58, insert -- master -- after "2 mhz";

Column 4, line 52, delete "made" after "is";

Column 5, line 7, insert -- , -- after "achieved";

Column 6, line 26, insert -- at -- after "forms";

Column 7, line 35, "215, 216, 216, 218" should be

-- 215, 216, 217, 218 --;

Column 8, line 7, "A", "B" generators" should be

-- "A", "B" and "C" generators --.

UNITED STATES PATENT AND TRADEMARK OFFICE

CERTIFICATE OF CORRECTION

PATENT NO. : 4,056,995

DATED : November 8, 1977

INVENTOR(S) : DALE M. UETRECHT

It is certified that error appears in the above-identified patent and that said Letters Patent are hereby corrected as shown below:

Column 6, line 39, "pluse" should be -- pulse --;

Column 7, line 50, "dirve" should be -- drive --;

Column 8, line 9, "1-2 kh" should be -- 1-2 khz --.

Signed and Sealed this

*Second* Day of *May 1978*

[SEAL]

*Attest:*

RUTH C. MASON
*Attesting Officer*

LUTRELLE F. PARKER
*Acting Commissioner of Patents and Trademarks*